US010731256B2

(12) United States Patent
Iwai et al.

(10) Patent No.: US 10,731,256 B2
(45) Date of Patent: Aug. 4, 2020

(54) PLATING APPARATUS, PLATING METHOD, AND RECORDING MEDIUM

(71) Applicant: Tokyo Electron Limited, Tokyo (JP)

(72) Inventors: Kazutoshi Iwai, Koshi (JP); Nobutaka Mizutani, Tokyo (JP); Yuichiro Inatomi, Koshi (JP); Takashi Tanaka, Koshi (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 115 days.

(21) Appl. No.: 15/479,429

(22) Filed: Apr. 5, 2017

(65) Prior Publication Data

US 2017/0292192 A1 Oct. 12, 2017

(30) Foreign Application Priority Data

Apr. 7, 2016 (JP) ..... 2016-077255

(51) Int. Cl.
*C23C 18/34* (2006.01)
*C23C 18/16* (2006.01)

(52) U.S. Cl.
CPC ..... *C23C 18/34* (2013.01); *C23C 18/163* (2013.01); *C23C 18/1619* (2013.01); *C23C 18/1632* (2013.01); *C23C 18/1675* (2013.01); *C23C 18/1676* (2013.01); *C23C 18/1678* (2013.01)

(58) Field of Classification Search
None
See application file for complete search history.

(56) References Cited

U.S. PATENT DOCUMENTS 6,458,208 B1 * 10/2002 Anai ..... B01D 19/0005 118/313
2009/0253258 A1 * 10/2009 Hara ..... C23C 18/1628 438/597

FOREIGN PATENT DOCUMENTS

JP 2009-249679 A 10/2009
JP 2013-010994 A 1/2013
JP 2013-010995 A 1/2013
JP 2015-034349 A 2/2015

* cited by examiner

*Primary Examiner* — Jethro M. Pence
(74) *Attorney, Agent, or Firm* — Pearne & Gordon LLP

(57) ABSTRACT

A plating apparatus, a plating method and a recording medium can allow a temperature of a wafer to be uniform within a surface thereof. A plating apparatus 1 includes a substrate holding unit 52 configured to hold a substrate W; a plating liquid supply unit 53 configured to supply a plating liquid M1 to the substrate W; and a solvent supply unit 55*a* configured to supply a solvent N1 having a different temperature from a temperature of the plating liquid M1 to the substrate W. The solvent N1 is supplied to a preset position on the substrate W from the solvent supply unit 55*a* after the plating liquid M1 is supplied to the substrate W from the plating liquid supply unit 53.

6 Claims, 6 Drawing Sheets

PLATING APPARATUS, PLATING METHOD, AND RECORDING MEDIUM

CROSS-REFERENCE TO RELATED APPLICATION

This application claims the benefit of Japanese Patent Application No. 2016-077255 filed on Apr. 7, 2016, the entire disclosures of which are incorporated herein by reference.

TECHNICAL FIELD

The embodiments described herein pertain generally to a plating apparatus, a plating method and a recording medium.

BACKGROUND

Conventionally, in a plating processing performed in a single-wafer type plating apparatus, it is required to make a temperature of a wafer uniform within a surface thereof. In the single-wafer type plating apparatus, however, a rotating device for rotating the wafer and a chemical liquid supply device for supplying a chemical liquid need to be provided at a rear surface side of the wafer and a front surface side thereof, respectively. For this reason, a sufficient space is difficult to secure at the front surface side of the wafer and the rear surface side thereof, and, thus, it is difficult to provide a temperature control device for directly heating the wafer at the front surface side of the wafer or the rear surface side thereof.

Thus, conventionally, there has been employed such a method of adjusting a temperature of a processing chemical liquid itself and supplying this temperature-controlled processing chemical liquid to the wafer, or a method of supplying a temperature-controlled chemical liquid or hot water to the rear surface side of the wafer. When such a conventional temperature control method is used, however, a temperature of a peripheral portion of the wafer cannot be increased sufficiently, though a central portion of the wafer can be heated in a relatively uniform manner. In this case, there is a concern that a thickness of a plating film may not be uniform within an entire surface of the wafer.

Patent Document 1: Japanese Patent Laid-open Publication No. 2009-249679

SUMMARY

In view of the foregoing, exemplary embodiments provide a plating apparatus, a plating method and a recording medium capable of allowing a temperature of a wafer to be uniform within a surface thereof.

In one exemplary embodiment, a plating apparatus includes a substrate holding unit configured to hold a substrate; a plating liquid supply unit configured to supply a plating liquid to the substrate; and a solvent supply unit configured to supply a solvent constituting the plating liquid and having a different temperature from a temperature of the plating liquid to the substrate. Here, the solvent is supplied to a preset position on the substrate from the solvent supply unit after the plating liquid is supplied to the substrate from the plating liquid supply unit.

In another exemplary embodiment, a plating method includes a substrate holding process of holding a substrate; a process of supplying a plating liquid to the substrate from a plating liquid supply unit; and a liquid supplying process of supplying a solvent having a temperature different from a temperature of the plating liquid to a preset position on the substrate from a solvent supply unit.

According to the exemplary embodiment, it is possible to allow the temperature of the wafer to be uniform within the surface thereof.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
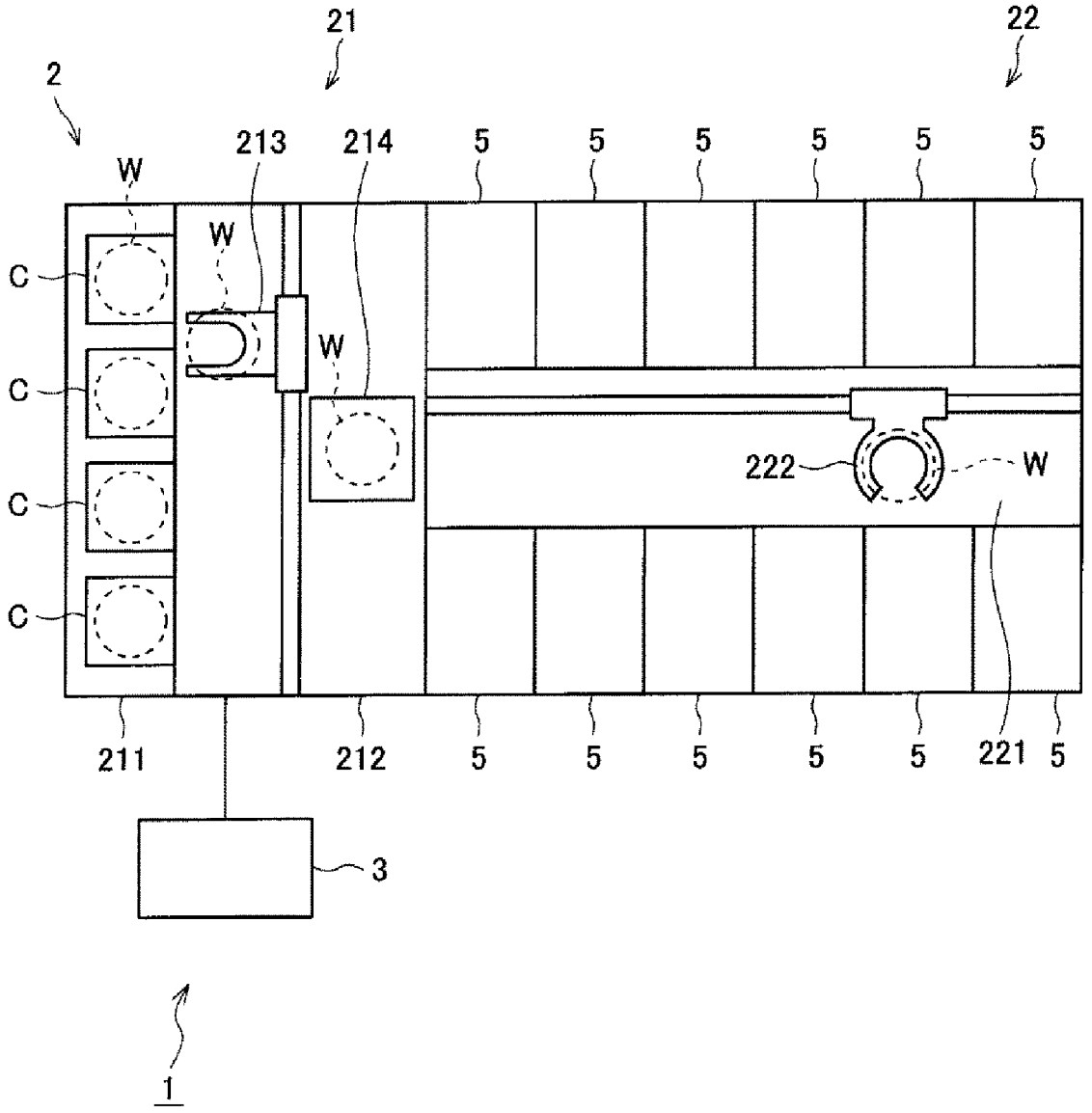
FIG. 1 is a schematic plan view illustrating a configuration of a plating apparatus and a plating unit provided in the plating apparatus.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current exemplary embodiment. Still, the exemplary embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, an exemplary embodiment will be explained in detail with reference to the accompanying drawings. Here, however, it should be noted that the present disclosure is not limited to the following exemplary embodiment.

<Configuration of Plating Apparatus>

Referring to FIG. 1, a configuration of a plating apparatus according to an exemplary embodiment will be explained. FIG. 1 is a schematic diagram illustrating the configuration of the plating apparatus according to the exemplary embodiment.

As depicted in FIG. 1, the plating apparatus 1 according to the exemplary embodiment includes a plating unit 2 and a controller 3 configured to control an operation of the plating unit 2.

The plating unit 2 is configured to perform various processings on a substrate. The various processings performed by the plating unit 2 will be described later.

The controller 3 is implemented by, for example, a computer, and includes an operation controller and a storage unit. The operation controller is implemented by, for example, a CPU (Central Processing Unit) and is configured to control the operation of the plating unit 2 by reading and executing a program stored in the storage unit. The storage unit is implemented by a storage device such as, but not limited to, a RAM (Random Access Memory), a ROM (Read Only Memory) or a hard disk, and stores thereon a program for controlling various processings performed in the plating unit 2. Further, the program may be recorded in a computer-readable recording medium, or may be installed from the recording medium to the storage unit. The computer-readable recording medium may be, for example, a hard disc (HD), a flexible disc (FD), a compact disc (CD), a magnet optical disc (MO), or a memory card. The recording medium has stored thereon a program that, when executed by a computer for controlling an operation of the plating apparatus 1, causes the plating apparatus 1 to perform a plating method to be described later under the control of the computer.

<Configuration of Plating Unit>

Referring to FIG. 1, a configuration of the plating unit 2 will be discussed. FIG. 1 is a schematic plan view illustrating the configuration of the plating unit 2.

The plating unit 2 includes a carry-in/out station 21; and a processing station 22 provided adjacent to the carry-in/out station 21.

The carry-in/out station 21 includes a placing section 211; and a transfer section 212 provided adjacent to the placing section 211.

In the placing section 211, multiple transfer containers (hereinafter, referred to as "carriers C") each of which accommodates a plurality of substrates W horizontally is placed.

The transfer section 212 is provided with a transfer device 213 and a delivery unit 214. The transfer device 213 is provided with a holding mechanism configured to hold a substrate W. The transfer device 213 is configured to be movable horizontally and vertically and pivotable around a vertical axis.

The processing station 22 includes plating devices 5. In the present exemplary embodiment, the number of the plating devices 5 provided in the processing station 22 may be two or more, but it is also possible to provide only one plating device 5. The plating devices 5 are arranged at both side of a transfer path 221 which is extended in a preset direction.

The transfer path 221 is provided with a transfer device 222. The transfer device 222 includes a holding mechanism configured to hold a substrate W, and is configured to be movable horizontally and vertically and pivotable around a vertical axis.

In the plating unit 2, the transfer device 213 of the carry-in/out station 21 is configured to transfer the substrate W between the carrier C and the delivery unit 214. To elaborate, the transfer device 213 takes out the substrate W from the carrier C placed in the placing section 211, and then, places the substrate W in the delivery unit 214. Further, the transfer device 213 takes out the substrate W which is placed in the delivery unit 214 by the transfer device 222 of the processing station 22, and then, accommodates the substrate W in the carrier C of the placing section 211.

In the plating unit 2, the transfer device 222 of the processing station 22 is configured to transfer the substrate W between the delivery unit 214 and the plating device 5 and between the plating device 5 and the delivery unit 214. To elaborate, the transfer device 222 takes out the substrate W placed in the delivery unit 214 and carries the substrate W into the plating device 5. Further, the transfer device 222 takes out the substrate W from the plating device 5 and places the substrate W in the delivery unit 214.

<Configuration of Plating Device>

Figure 2:
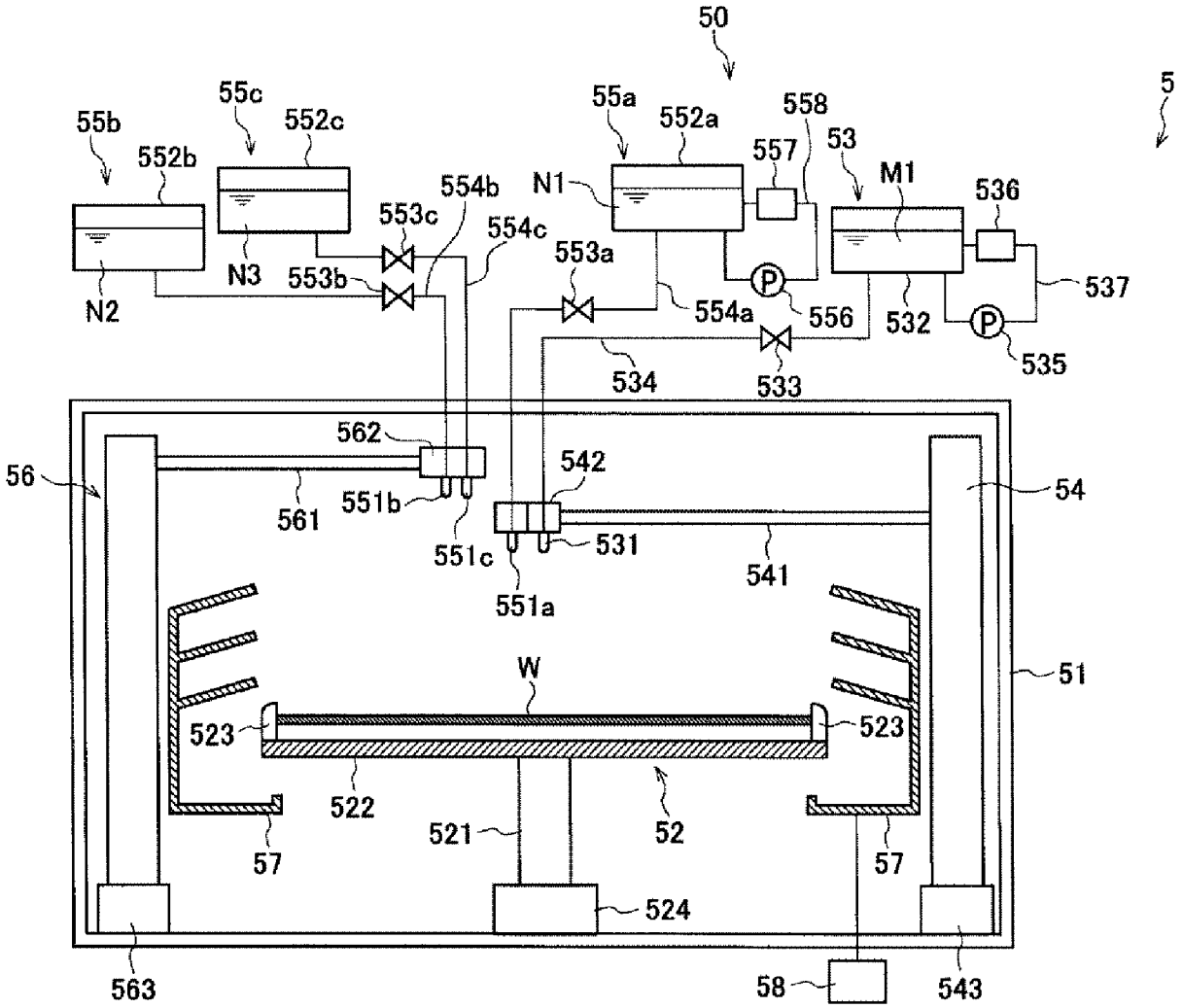
FIG. 2 is a schematic cross sectional view illustrating a configuration of a plating device provided in the plating unit.

Referring to FIG. 2, a configuration of the plating device 5 will be explained. FIG. 2 is a schematic cross sectional view illustrating the configuration of the plating device 5.

The plating device 5 is configured to perform a substrate processing including an electroless plating processing. The plating device 5 includes a chamber 51; a substrate holding unit 52 provided within the chamber 51 and configured to hold the substrate W; and a plating liquid supply unit 53 configured to supply a plating liquid M1 to the substrate W held by the substrate holding unit 52.

The substrate holding unit 52 includes a rotation shaft 521 extended in a vertical direction within the chamber 51; a turntable 522 provided at an upper end portion of the rotation shaft 521; a chuck 523 provided on an outer peripheral portion of a top surface of the turntable 522 and configured to support an edge portion of the substrate W; and a driving unit 524 configured to rotate the rotation shaft 521.

The substrate W is supported by the chuck 523 to be horizontally held on the turntable 522 while being slightly spaced apart from the top surface of the turntable 522. In the present exemplary embodiment, a mechanism of holding the substrate W by the substrate holding unit 52 is of a so-called mechanical chuck type in which the edge portion of the substrate W is held by the chuck 523 which is configured to be movable. However, a so-called vacuum chuck type of vacuum attracting a rear surface of the substrate W may be used instead.

A base end portion of the rotation shaft 521 is rotatably supported by the driving unit 524, and a leading end portion of the rotation shaft 521 sustains the turntable 522 horizontally. If the rotation shaft 521 is rotated, the turntable 522 placed on the upper end portion of the rotation shaft 521 is rotated, and, as a result, the substrate W which is held on the turntable 522 by the chuck 523 is also rotated. Further, a non-illustrated temperature control liquid supply device may be provided within the rotation shaft 521 and may be configured to supply a temperature control fluid such as hot water, vapour or a chemical liquid toward the rear surface of the substrate W from the side of the substrate holding unit 52.

The plating liquid supply unit 53 is equipped with a plating liquid nozzle 531 configured to discharge the plating liquid M1 onto the substrate W held by the substrate holding unit 52; and a plating liquid supply source 532 configured to supply the plating liquid M1 to the plating liquid nozzle 531. The plating liquid M1 is stored in a tank of the plating liquid supply source 532, and the plating liquid M1 is supplied into the plating liquid nozzle 531 from the plating liquid supply source 532 through a supply passageway 534 which is equipped with a flow rate controller such as a valve 533.

The plating liquid M1 is an autocatalytic (reduction) plating liquid for electroless plating. The plating liquid M1 contains, for example, a metal ion such as a cobalt (Co) ion, a nickel (Ni) ion, a tungsten (W) ion, a copper (Cu) ion, a palladium (Pd) ion, a gold (Au) ion; and a reducing agent such as hypophosphorous acid or dimethylamineborane. The plating liquid M1 may further contain an additive or the like. The metal film (plating film) formed by the plating processing with the plating liquid M1 may be, by way of non-limiting example, CoWB, CoB, CoWP, CoWBP, NiWB, NiB, NiWP, NiWBP, or the like.

A circulation passageway 537 provided with a pump 535 and a heating unit 536 is connected to the tank of the plating liquid supply source 532. The plating liquid M1 in the tank is heated or controlled to have a preset temperature while being circulated through the circulation passageway 537. Then, the heated plating liquid M1 is discharged from the plating liquid nozzle 531. Further, the plating liquid M1 may be further heated or temperature-controlled in a supply passageway 534. A discharge temperature of the plating liquid M1 is in the range from 55° C. to 75° C. and, more desirably, in the range from 60° C. to 70° C.

The plating liquid nozzle 531 is connected to a nozzle moving mechanism 54. The nozzle moving mechanism 54 is configured to drive the plating liquid nozzle 531. The nozzle moving mechanism 54 includes an arm 541, a moving body 542 which is configured to be movable along the arm 541 and has a driving mechanism embedded therein; and a rotating/elevating mechanism 543 configured to rotate and move the arm 541 up and down. The plating liquid nozzle 531 is provided at the moving body 542. The nozzle moving mechanism 54 is capable of moving the plating liquid nozzle 531 between a position above a center of the substrate W held by the substrate holding unit 52 and a position above a periphery of the substrate W, and is also capable of moving the nozzle 531 up to a stand-by position outside a cup 57 to be described later when viewed from the top.

The solvent supply unit 55*a* includes a solvent nozzle 551*a* configured to discharge a solvent N1 onto the substrate W held by the substrate holding unit 52; and a solvent supply source 552*a* configured to supply the solvent N1 to the solvent nozzle 551*a*. The solvent N1 is stored in a tank of the solvent supply source 552*a*, and the solvent N1 is supplied to the solvent nozzle 551*a* from the solvent supply source 552*a* through a supply passageway 554*a* which is provided with a flow rate controller such as a valve 553*a*.

The solvent N1 contains one of solvents constituting the plating liquid M1. As an example of this solvent N1, a liquid such as water, a solvent having an adjusted pH or a surfactant-mixed liquid or a gas such as vapor may be used. Further, it is desirable that the solvent N1 does not contain a plating component constituting the plating liquid M1 such as CoWB, CoB, CoWP, CoWBP, NiWB, NiB, NiWP or NiWBP.

A circulation passageway 558 provided with a pump 556 and a heating unit 557 is connected to the tank of the solvent supply source 552*a*. The solvent N1 in the tank is heated or controlled to have a preset temperature while being circulated through the circulation passageway 558. Then, the heated solvent N1 is discharged from the solvent nozzle 551*a*. Further, the solvent N1 may be further heated or temperature-controlled in a supply passageway 554*a*. A discharge temperature of the solvent N1 is higher than the discharge temperature of the plating liquid. Specifically, the discharge temperature of the solvent N1 is in the range from 75° C. to 90° C. and, more desirably, in the range from 80° C. to 90° C.

In the present exemplary embodiment, the solvent nozzle 551*a* is mounted to the moving body 542 along with the plating liquid nozzle 531. Accordingly, the plating liquid nozzle 531 and the solvent nozzle 551*a* are configured to be movable above the substrate W as one body. That is, the nozzle moving mechanism 54 is capable of moving the plating liquid nozzle 531 and the solvent nozzle 551*a* to a certain position between the position above the center of the substrate W and the position above the periphery portion of the substrate W.

The above-described plating liquid supply unit 53 and the solvent supply unit 55*a* constitute a liquid supply unit 50.

The plating device 5 is further equipped with a cleaning liquid supply unit 55*b* and a rinse liquid supply unit 55*c* configured to supply a cleaning liquid N2 and a rinse liquid N3 onto the substrate W held by the substrate holding unit 52, respectively.

The cleaning liquid supply unit 55*b* includes a nozzle 551*b* configured to discharge the cleaning liquid N2 onto the substrate W held by the substrate holding unit 52; and a cleaning liquid supply source 552*b* configured to supply the cleaning liquid N2 to the nozzle 551*b*. The cleaning liquid N2 is stored in a tank of the cleaning liquid supply source 552*b*, and the cleaning liquid N2 is supplied to the nozzle 551*b* from the cleaning liquid supply source 552*b* through a supply passageway 554*b* which is provided with a flow rate controller such as a valve 553*b*.

As an example of the cleaning liquid N2, an organic acid such as a formic acid, malic acid, a succinic acid, a citric acid or a malonic acid, or hydrofluoric acid (DHF) (aqueous solution of hydrogen fluoride) diluted to the extent that it does not corrode the plating target surface of the substrate W may be used.

The rinse liquid supply unit 55*c* includes a nozzle 551*c* configured to discharge the rinse liquid N3 onto the substrate W held by the substrate holding unit 52; and a rinse liquid supply source 552*c* configured to supply the rinse liquid N3 to the nozzle 551*c*. The rinse liquid N3 is stored in a tank of the rinse liquid supply source 552*c*, and the rinse liquid N3 is supplied to the nozzle 551*c* from the rinse liquid supply source 552*c* through a supply passageway 554*c* which is provided with a flow rate controller such as a valve 553*c*.

As an example of the rinse liquid N3, pure water may be used.

The plating device 5 includes a nozzle moving mechanism 56 configured to move the nozzles 551*b* and 551*c*. The nozzle moving mechanism 56 is equipped with an arm 561; a moving body 562 which is configured to be movable along the arm 561 and has a moving mechanism embedded therein; and a rotating/elevating mechanism 563 configured to rotate and move the arm 561 up and down. The nozzles 551*b* and 551*c* are provided at the moving body 562. The nozzle moving mechanism 56 is capable of moving the nozzles 551*b* and 551*c* between a position above the central portion of the substrate W held by the substrate holding unit 52 and a position above the peripheral portion of the substrate W, and also capable of moving the nozzles 551*b* and 551*c* up to a stand-by position outside the cup 57 to be described later when viewed from the top. In the present exemplary embodiment, though the nozzles 551*b* and 551*c* are held by the common arm, they may be configured to be held by different arms and moved independently.

The cup 57 is disposed around the substrate holding unit 52. The cup 57 is configured to receive various kinds of processing liquids (e.g., the plating liquid, the cleaning liquid, the rinse liquid, etc.) scattered from the substrate W and drain the received processing liquids to the outside of the chamber 51. The cup 51 is equipped with an elevating mechanism 58 configured to move the cup 57 up and down.

<Plating Method>

Now, a plating method performed by the plating apparatus 1 will be explained. The plating method performed by the plating apparatus 1 includes a plating processing upon a substrate W. The plating processing is performed by the plating device 5. An operation of the plating device 5 to be described below is controlled by the controller 3.

First, the substrate W is carried into the plating device 5 and is held by the substrate holding unit 52 (see FIG. 2). In the meanwhile, the controller 3 controls the elevating mechanism 58 to move the cup 57 down to a preset position. Then, the controller 3 controls the transfer device 222 to place the substrate W on the substrate holding unit 52. The substrate W is horizontally placed on the turntable 522 while its periphery portion is held by the chuck 523.

Then, the substrate W held by the substrate holding unit 52 is cleaned. At this time, while controlling the driving unit 524 to rotate the substrate W held by the substrate holding unit 52 at a preset speed, the controller 3 controls the cleaning liquid supply unit 55*b* to locate the nozzle 551*b* at a position above the substrate W and to supply a cleaning liquid N2 onto the substrate W from the nozzle 551*b*. The cleaning liquid N2 supplied onto the substrate W is diffused on the surface of the substrate W by a centrifugal force which is caused by the rotation of the substrate W. As a result, a deposit or the like adhering to the substrate W is removed from the substrate W. The cleaning liquid N2 scattered from the substrate W is drained through the cup 57.

Subsequently, the substrate W after being cleaned is rinsed. At this time, while controlling the driving unit 524 to rotate the substrate W held by the substrate holding unit 52 at a preset speed, the controller 3 controls the rinse liquid supply unit 55*c* to locate the nozzle 551*c* at a position above the substrate W, and to supply a rinse liquid N3 onto the substrate W from the nozzle 551*c*. The rinse liquid N3 supplied onto the substrate W is diffused on the surface of the substrate W by a centrifugal force which is caused by the rotation of the substrate W. As a result, the cleaning liquid N2 remaining on the substrate W is washed away. The rinse liquid N3 scattered from the substrate W is drained through the cup 57.

Further, a catalyst imparting processing may be performed on the substrate W after being rinsed by a non-illustrated catalyst supply unit after the rinsing processing.

Figure 3A:
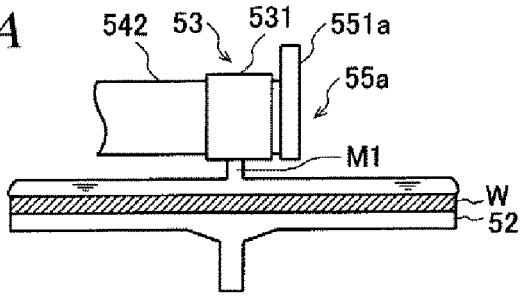
FIG. 3A to FIG. 3E are schematic diagrams illustrating a plating method according to an exemplary embodiment.

Subsequently, a plating processing is performed on the substrate W. The plating processing includes a plating liquid replacement processing, a plating liquid accumulation processing and a plating liquid processing. Here, while controlling the driving unit 524 to rotate the substrate W held by the substrate holding unit 52 at a preset speed (e.g., 100 rpm to 300 rpm), the controller 3 controls the plating liquid supply unit 53 to locate the plating liquid nozzle 531 at a position above a central portion of the substrate W and to supply a plating liquid M1 to the substrate W from the plating liquid nozzle 531 (see FIG. 3A). Accordingly, the rinse liquid N3 on the surface of the substrate W is rapidly replaced with the plating liquid M1.

Upon the completion of the plating liquid replacement processing, the controller 3 reduces the rotational speed of the substrate W held by the substrate holding unit 52 (e.g., to 50 rpm to 150 rpm) and starts the plating liquid accumulation processing by controlling the plating liquid supply unit 53. During the plating liquid accumulation processing, the plating liquid M1 is supplied onto the substrate W from the plating liquid supply unit 53, and a solvent N1 having a temperature different from that of the plating liquid M1 is supplied onto the substrate W from the solvent supply unit 55*a* at a preset timing as will be described later (liquid supplying process). Hereinafter, this liquid supplying process will be elaborated.

Figure 3B:
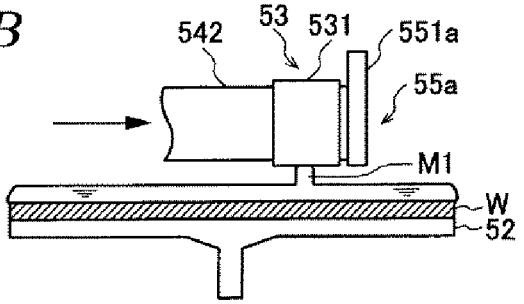

First, while supplying the plating liquid M1 toward the substrate W from the plating liquid nozzle 531, the plating liquid nozzle 531 is moved from a central portion side of the substrate W toward a peripheral portion side thereof (first moving process) (see FIG. 3B). At this time, the solvent nozzle 551*a* is also moved as one body with the plating liquid nozzle 531, but the supply of the solvent N1 from the solvent nozzle 551*a* is stopped. Accordingly, the central portion of the substrate W is heated by heat from the plating liquid M1. The temperature of the plating liquid M1 is in the range from, for example, 55° C. to 75° C., and, more desirably, from 60° C. to 70° C.

Figure 3C:
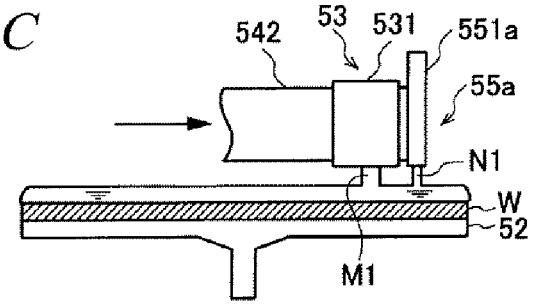

Subsequently, when the plating liquid nozzle 531 reaches a certain position from the position above the central portion side of the substrate W to a position above the peripheral portion side of the substrate W, the solvent supply unit 55*a* is controlled, and the supply of the solvent N1 from the solvent nozzle 551*a* is begun. In this state, the plating liquid nozzle 531 and the solvent supply unit 55*a* are further moved toward the position above the peripheral portion side of the substrate W (second moving process) (see FIG. 3C). In the meantime, the plating liquid nozzle 531 continues to supply the plating liquid M1, the plating liquid M1 and the solvent N1 are mixed on the surface of the substrate W. As stated above, the temperature of the solvent N1 is higher than the temperature of the plating liquid M1. For example, the temperature of the solvent N1 is in the range from, e.g., 75° C. to 95° C., and, more desirably, 80° C. to 90° C. Therefore, the temperature of the mixed liquid of the plating liquid M1 and the solvent N1 is higher than the temperature of the plating liquid M1. Thus, a region of the peripheral portion side of the substrate W is heated more strongly than a region of the central portion side of the substrate W by the heat of the mixed liquid of the plating liquid M1 and the solvent N1.

Furthermore, a flow rate ratio between the plating liquid M1 and the solvent N1 is in the range from, e.g., 90:10 to 50:50. Further, a total flow rate of the plating liquid M1 and the solvent N1 is maintained at a constant value. Alternatively, while maintaining the flow rate of the plating liquid M1 constant, the flow rate of the solvent N1 may be varied. Still alternatively, the flow rates of the plating liquid M1 and the solvent N1 may be varied during the plating liquid accumulation processing.

Figure 3D:
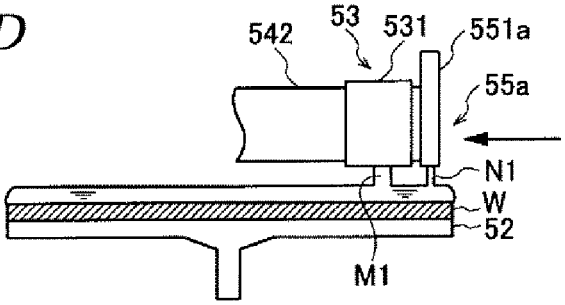

Subsequently, after the plating liquid nozzle 531 reaches the position above the peripheral portion side of the substrate W, the plating liquid nozzle 531 is returned from the position above the peripheral portion side of the substrate W toward the position above the central portion side thereof (third moving process) (see FIG. 3D). At this time, the supply of the plating liquid M1 from the plating liquid nozzle 531 and the supply of the solvent N1 from the solvent nozzle 551*a* are continued. Accordingly, the region of the peripheral portion side of the substrate W is kept heated by the heat from the mixed liquid of the plating liquid M1 and the solvent N1.

Figure 3E:
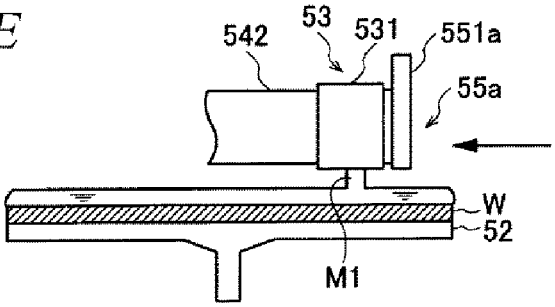

Thereafter, when the plating liquid nozzle 531 reaches a certain position from the position above the peripheral portion side of the substrate W and the position above the central portion side thereof, the solvent supply unit 55*a* is controlled, and the supply of the solvent N1 from the solvent nozzle 551*a* is stopped. In this state, the plating liquid nozzle 531 is further moved toward the position above the central portion side of the substrate W (fourth moving process) (see FIG. 3E). In the meantime, since the plating liquid nozzle 531 continues to supply the plating liquid M1, the region of the central portion side of the substrate W is heated by the heat from the plating liquid M1. The degree of this heating is weak as compared to the degree of heating of the peripheral portion side of the substrate W.

As stated above, in the liquid supplying process, since the plating liquid M1 and the solvent N1 are supplied together for at least a certain time period, a preset position on the substrate W, specifically, a region (e.g., the peripheral portion side) of the substrate W intended to be heated can be intensively heated with the mixed liquid of the plating liquid M1 and the solvent N1.

Further, afterwards, the plating liquid nozzle 531 and the solvent supply unit 55*a* may be further moved between the position above the peripheral portion side of the substrate W and the position of the central portion side thereof, and the plating liquid accumulation processing may be continued.

Then, the controller 3 controls the plating liquid supply unit 53 to move the plating liquid nozzle 531 to a position above a location displaced from the center of the substrate W by, e.g., 30 mm to 100 mm, more desirably, by 30 mm to 70 mm in a radial direction. In this state, the plating liquid M1 is supplied to the substrate W from the plating liquid nozzle 531. Accordingly, the plating liquid is diffused on the entire surface of the substrate W, so that the plating liquid processing is performed.

After the plating processing including the above described series of processes is completed, the substrate W held by the substrate holding unit 52 is cleaned. At this time, while controlling the driving unit 524 to rotate the substrate W held by the substrate holding unit 52 at a preset speed, the controller 3 controls the cleaning liquid supply unit 55*b* to locate the nozzle 551*b* at the position above the substrate W and to supply the cleaning liquid N2 onto the substrate W from the nozzle 551*b*. The cleaning liquid N2 supplied onto the substrate W is diffused on the surface of the substrate W by a centrifugal force which is caused by the rotation of the substrate W. Accordingly, the abnormal plating film or the reaction by-product adhering to the substrate W is removed from the substrate W. The cleaning liquid N2 scattered from the substrate W is drained through the cup 57.

Then, while controlling the driving unit 524 to rotate the substrate W held by the substrate holding unit 52 at a preset speed, the controller 3 controls the rinse liquid supply unit 55*c* to locate the nozzle 551*c* at the position above the substrate W and to supply the rinse liquid N3 onto the substrate W from the nozzle 551*c*. Accordingly, the plating liquid M1, the cleaning liquid N2 and the rinse liquid N3 on the substrate W are scattered from the substrate W by a centrifugal force which is caused by the rotation of the substrate W, and are drained through the cup 57.

Thereafter, the substrate W is carried out of the plating device 5. At this time, the controller 3 controls the transfer device 222 to take out the substrate W from the plating device 5 and place the taken-out substrate W in the delivery unit 214. Then, the controller 3 controls the transfer device 213 to take out the substrate W placed on the delivery unit 214 and to carry the substrate W into the carrier C in the placing section 211.

As stated above, according to the present exemplary embodiment, the plating liquid M1 is supplied onto the substrate W from the plating liquid nozzle 531, and, afterwards, the solvent N1 having the higher temperature than the plating liquid M1 is supplied to a preset position on the substrate W from the solvent nozzle 551*a* (liquid supplying process). To elaborate, while the plating liquid nozzle 531 is being moved above the central portion side of the substrate W, only the plating liquid M1 is supplied onto the substrate W. Meanwhile, while the plating liquid nozzle 531 is being moved in a region above the peripheral portion side of the substrate W, the solvent N1 from the solvent nozzle 551*a* as well as the plating liquid M1 is supplied. Accordingly, since the peripheral portion side of the substrate W is heated more strongly than the central portion side thereof, it is possible to sufficiently increase the temperature of the peripheral portion side of the substrate W which otherwise is highly likely to have a relatively lower temperature than that of the central portion side of the substrate W, so that the temperature of the substrate W can be uniform within the surface of the substrate W. Accordingly, the thickness of the plating film can be uniform within the surface of the substrate W.

Furthermore, according to the present exemplary embodiment, since the solvent N1 contained in the plating liquid M1 is used as the fluid for heating the peripheral portion side of the substrate W, there is no influence upon the plating processing. Moreover, there is no concern that the consumption amount of the plating liquid M1 is increased.

MODIFICATION EXAMPLES

Now, various modification examples of the present exemplary embodiment will be explained.

In the above described exemplary embodiment, there has been described an example case of setting the temperature of the solvent N1 to be higher than the temperature of the plating liquid M1. However, the exemplary embodiment is not limited thereto. To the contrary, the temperature of the solvent N1 may be set to be lower than the temperature of the plating liquid M1. In this cases, when the plating liquid nozzle 531 is moved above the central portion side of the substrate W, the solvent N1 having a relatively low temperature may be supplied to the preset position of the substrate W (region of the central portion side of the substrate W) from the solvent nozzle 551*a* along with the plating liquid M1 from the plating liquid nozzle 531. Meanwhile, when the plating liquid nozzle 531 is moved above the peripheral portion side of the substrate W, only the plating liquid M1 may be supplied to the substrate W. Accordingly, the temperature of the peripheral portion side of the substrate W, which otherwise may have a lower temperature, can be increased sufficiently, so that the temperature of the substrate W can be uniform within the entire surface of the substrate W.

Further, in the above-described exemplary embodiment, there has been described for an example case that, while the plating liquid nozzle 531 is being moved above the peripheral portion side of the substrate W, the plating liquid M1 and the solvent N1 are supplied together. However, the plating liquid M1 and the solvent N1 may not necessarily be supplied at the same time as long as the mixed liquid of the plating liquid M1 and the solvent N1 is generated on the substrate W. By way of example, only the plating liquid M1 may be supplied to the substrate W from the plating liquid nozzle 531, and, then, the supply of the plating liquid M1 from the plating liquid nozzle 531 is stopped, and then, only the solvent N1 may be supplied to the preset position of the substrate W from the solvent nozzle 551*a*.

In addition, though, in the above-described exemplary embodiment, there has been described an example case where the plating liquid nozzle 531 and the solvent nozzle 551*a* are arranged side by side as one body, the exemplary embodiment may not be limited thereto. By way of example, as depicted in FIG. 4 to FIG. 9, the arrangement of the plating liquid nozzle 531 and the solvent nozzle 551*a* may be different from the above-described exemplary embodiment. Below, modification examples of the arrangement of the plating liquid nozzle 531 and the solvent nozzle 551*a* may be further explained.

Figure 4:
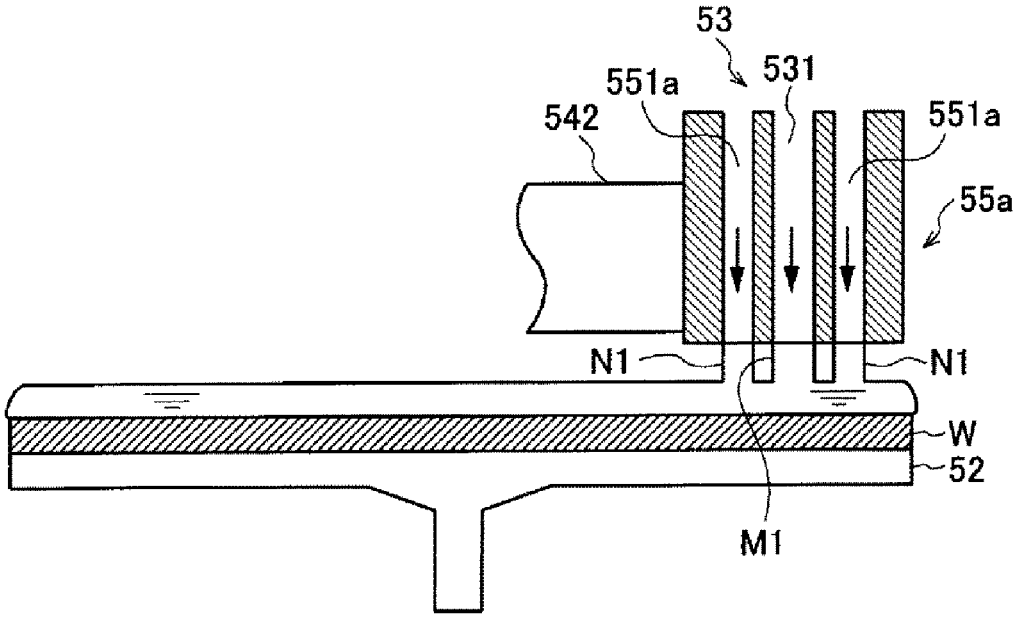
FIG. 4 is a schematic diagram illustrating a modification example of a plating liquid supply unit and a solvent supply unit.

As depicted in FIG. 4, the plating liquid nozzle 531 and the solvent nozzle 551*a* may have a dual structure. In this example, the plating liquid nozzle 531 is located at the center, and the solvent nozzle 551*a* is provided to surround the plating liquid nozzle 531. When viewed from the top, the solvent nozzle 551*a* may have an annular shape such as a circular shape, or a C-shape. In FIG. 4, as the solvent nozzle 551*a* is disposed around the plating liquid nozzle 531, the plating liquid M1 and the solvent N1 can be mixed more efficiently.

Figure 5:
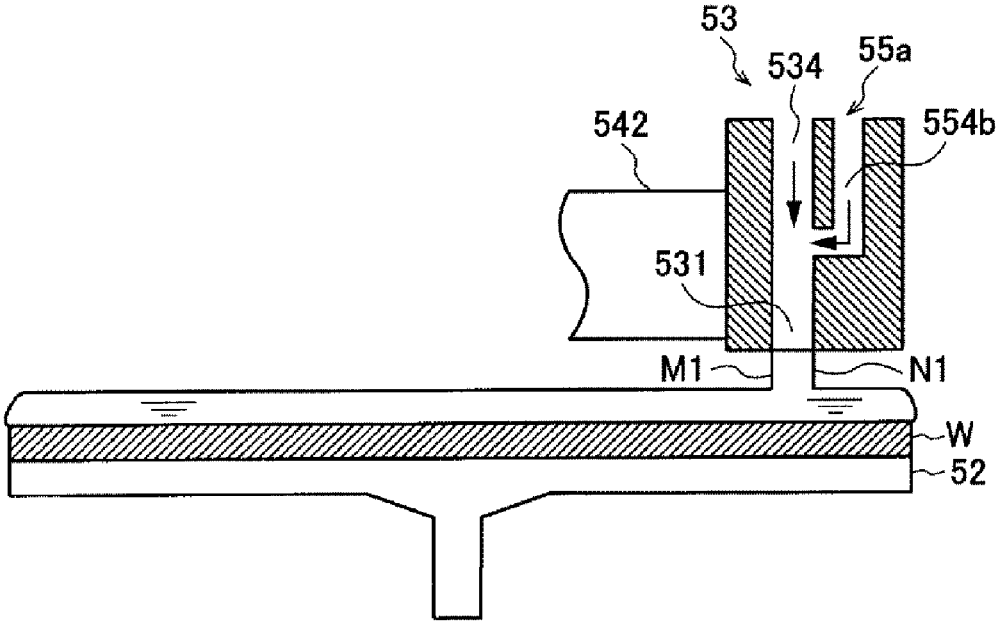
FIG. 5 is a schematic diagram illustrating a modification example of the plating liquid supply unit and the solvent supply unit.

As illustrated in FIG. 5, instead of providing the solvent nozzle 551*a*, the supply passageway 554*b* of the solvent supply unit 55*a* may be connected to a portion of the pipeline (supply passageway 534) of the plating liquid nozzle 531. In this case, the solvent N1 from the solvent supply unit 55*a* is mixed with the plating liquid M1 within the supply passageway 534 and is supplied from the plating liquid nozzle 531. In this case, the plating liquid M1 and the solvent N1 can be mixed more efficiently.

Figure 6:
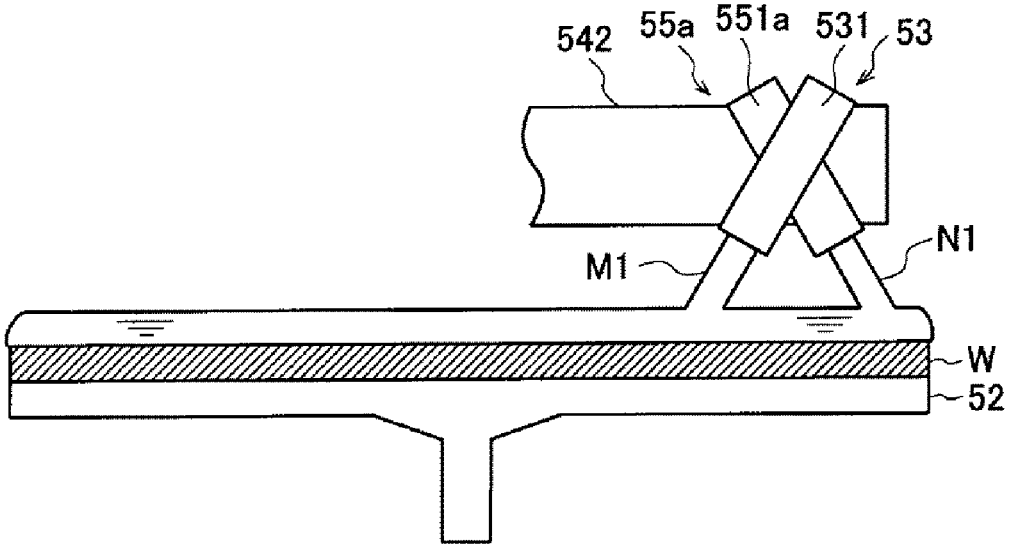
FIG. 6 is a schematic diagram illustrating a modification example of the plating liquid supply unit and the solvent supply unit.

As shown in FIG. 6, the plating liquid nozzle 531 and the solvent nozzle 551*a* may be provided to be inclined with respect to the surface of the substrate W. In this case, when viewed from the side, the plating liquid nozzle 531 and the solvent nozzle 551*a* may be inclined in different directions. Accordingly, agitation of the plating liquid M1 and the solvent N1 on the substrate W which is being rotated can be facilitated, so that it is possible to promote the mixing of the plating liquid M1 and the solvent N1. Furthermore, inclination angles of the plating liquid nozzle 531 and the solvent nozzle 551*a* can be appropriately adjusted.

Figure 7:
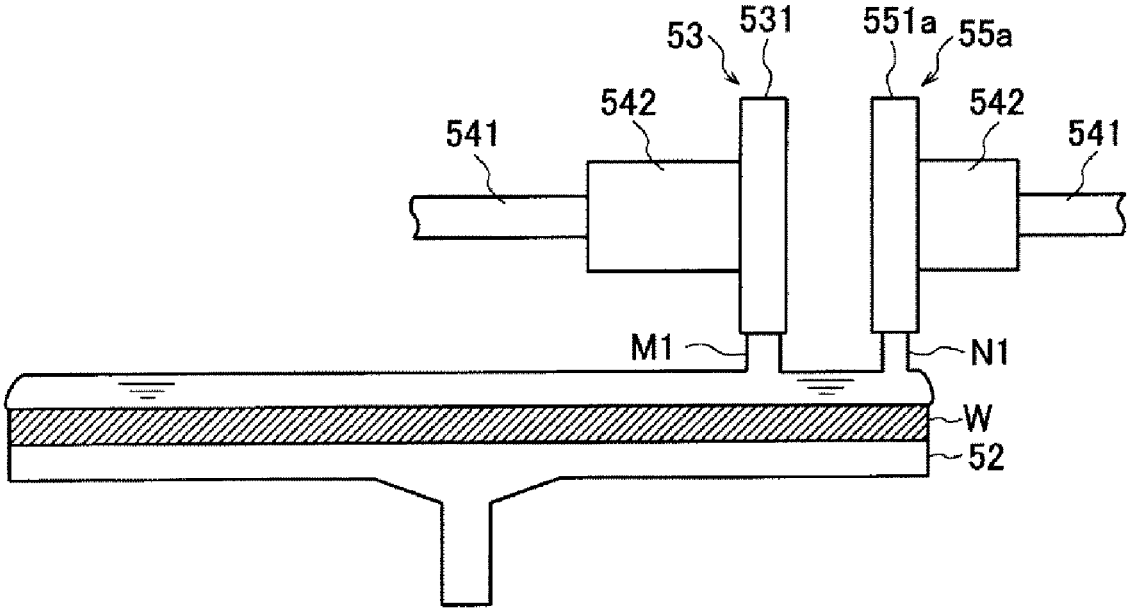
FIG. 7 is a schematic diagram illustrating a modification example of the plating liquid supply unit and the solvent supply unit.

As depicted in FIG. 7, the plating liquid nozzle 531 and the solvent nozzle 551*a* may be mounted to separate arms 541 and 541 and separate moving bodies 542 and 542, and configured to be movable above the substrate W separately. Accordingly, the position of the plating liquid nozzle 531 and the position of the solvent nozzle 551*a* can be controlled independently. Thus, regardless of the position of the plating liquid nozzle 531, an appropriate amount of the solvent N1 can be supplied to an appropriate position on the substrate W from the solvent nozzle 551*a*.

Figure 8:
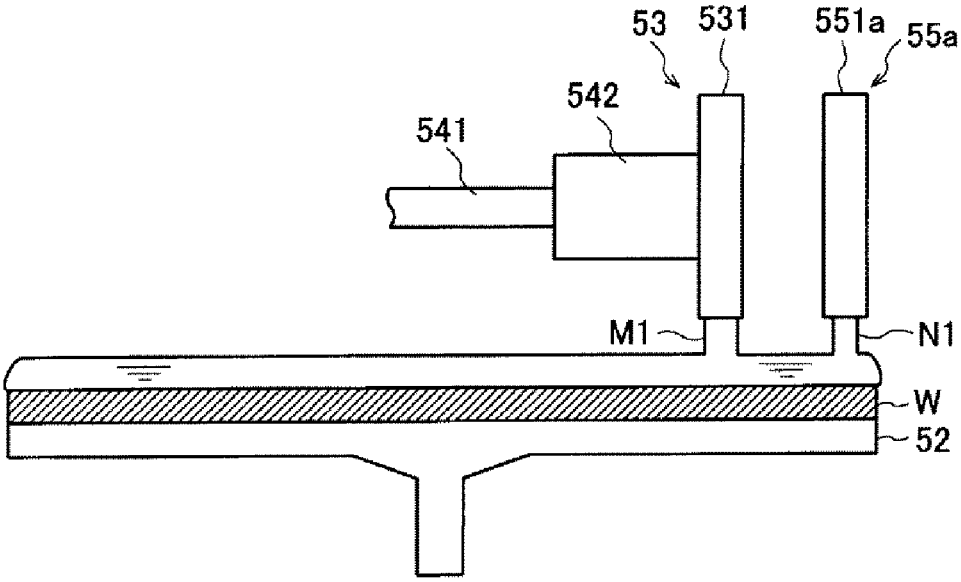
FIG. 8 is a schematic diagram illustrating a modification example of the plating liquid supply unit and the solvent supply unit.

As illustrated in FIG. 8, the solvent nozzle 551*a* may be located at a fixed position above the substrate W. Particularly, by fixing the solvent nozzle 551*a* at a position above the peripheral portion of the substrate W, the temperature of the peripheral portion of the substrate W can be efficiently increased. Here, the expression that "the solvent nozzle 551*a* is located at the fixed position above the substrate W" implies that the solvent nozzle 551*a* is not moved and fixed at the fixed position when the solvent nozzle 551*a* is placed above the substrate W. Further, the solvent nozzle 551*a* may be configured to be movable to a stand-by position outside the cup 57, for example.

Figure 9:
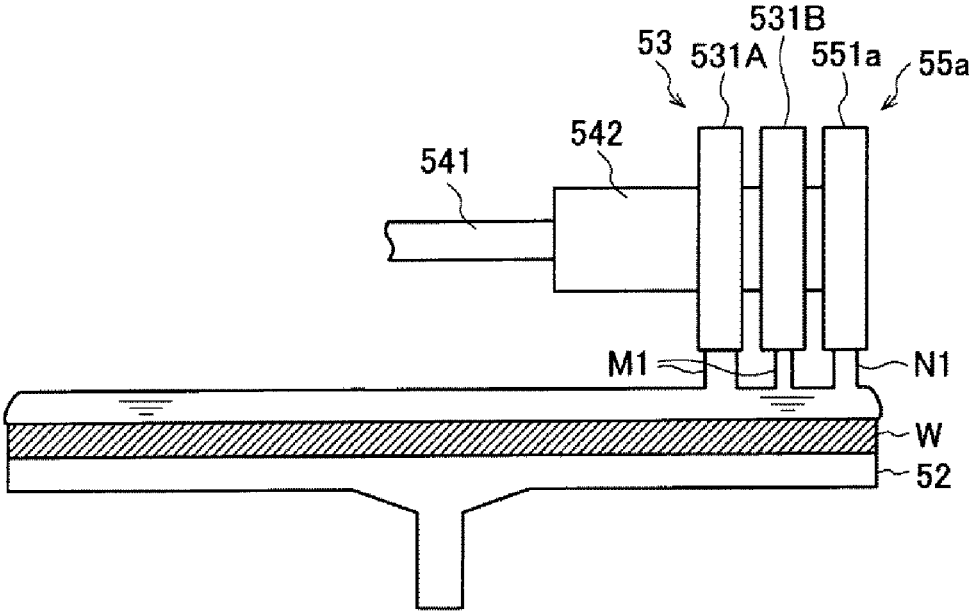
FIG. 9 is a schematic diagram illustrating a modification example of the plating liquid supply unit and the solvent supply unit.

As depicted in FIG. 9, at least one of the plating liquid nozzle 531 and the solvent nozzle 551*a* may be provided in two or more. By way of example, in FIG. 9, two plating liquid nozzles 531A and 531B are provided, and one solvent nozzle 551*a* is provided. The plating liquid nozzles 531A and 531B and the solvent nozzle 551*a* are formed as one body. The plating liquid nozzles 531A and 531B may be configured to discharge the plating liquid M1 (same component) at different flow rates. Accordingly, responsiveness to the discharge of the plating liquid M1 from the plating liquid nozzles 531A and 531B is increased, and the flow rate of the plating liquid M1 can be stabilized.

The above-described exemplary embodiments are not limiting, and various changes and modifications may be made to the constituent components without departing from the scope of the present disclosure. Further, various inventions may be conceived by combining multiple constituent components appropriately. Some of the constituent components disclosed in the present exemplary embodiments can be omitted, and constituent components from the different exemplary embodiments may be appropriately combined.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting. The scope of the inventive concept is defined by the following claims and their equivalents rather than by the detailed description of the exemplary embodiments. It shall be understood that all modifications and embodiments conceived from the meaning and scope of the claims and their equivalents are included in the scope of the inventive concept.

We claim:

1. A plating apparatus, comprising:

a substrate holder configured to hold a substrate horizontally;

a driving unit configured to rotate the substrate held by the substrate holder;

a plating liquid nozzle configured to supply a plating liquid to a top surface of the substrate;

a solvent nozzle configured to supply a solvent constituting the plating liquid to the surface of the substrate to which the plating liquid is being supplied or has been supplied;

a first heater coupled to the plating liquid nozzle to heat the plating liquid to a first temperature before supplying the plating liquid to the substrate from the plating liquid nozzle; and a second heater coupled to the solvent nozzle to heat the solvent to a second temperature before supplying the solvent to the substrate from the solvent nozzle wherein the second temperature by the second heater is higher than the first temperature by the first heater, the plating liquid nozzle and the solvent nozzle are configured to be moved together above the substrate as one body, and the plating liquid nozzle and the solvent nozzle are inclined in different directions when viewed from a side surface of the substrate.

2. The plating apparatus of claim 1, wherein the solvent nozzle is disposed to surround the plating liquid nozzle.

3. The plating apparatus of claim 1, wherein at least one of the plating liquid nozzle and the solvent nozzle is provided in two or more.

4. The plating apparatus of claim 1, further comprising:

a controller configured to control the plating liquid nozzle and the solvent nozzle, wherein the controller is further configured to execute:

supplying the plating liquid to the substrate from the plating liquid nozzle; and supplying the solvent having a temperature different from a temperature of the plating liquid to a preset position on the substrate from the solvent nozzle.

5. The plating apparatus of claim 4, wherein the controller is further configured to control the plating liquid nozzle and the solvent nozzle such that the plating liquid and the solvent are simultaneously supplied for at least a preset time period in the supplying of the solvent.

6. The plating apparatus of claim 4, wherein the controller is further configured to sequentially execute the supplying of the plating liquid and the supplying of the solvent.

* * * * *